United States Patent [19]

Horan

[11] 4,090,270

[45] May 23, 1978

[54] MINI-BOAT

[76] Inventor: John J. Horan, 420 Quigley Ave., Willow Grove, Pa. 19090

[21] Appl. No.: 745,736

[22] Filed: Nov. 29, 1976

[51] Int. Cl.[2] ..... B63B 7/00

[52] U.S. Cl. ..... 9/2 A; 9/11 A

[58] Field of Search ..... 9/11 A, 2 A, 347, 348; 297/DIG. 3

[56] References Cited

U.S. PATENT DOCUMENTS

| | | | |
|---|---|---|---|
| 1,372,528 | 3/1921 | Marcovsky | 9/2 A |
| 2,437,602 | 3/1948 | Hann | 9/11 A X |
| 2,508,304 | 5/1950 | Sturtevant | 9/2 A |
| 2,962,732 | 12/1960 | März | 9/2 A |
| 3,235,892 | 2/1966 | Emery | 9/347 |
| 3,761,979 | 10/1973 | Daughenbaugh | 9/11 A |

FOREIGN PATENT DOCUMENTS

| | | | |
|---|---|---|---|
| 561,929 | 10/1955 | Canada | 9/11 A |
| 597,984 | 5/1960 | Canada | 9/11 A |
| 326,248 | 5/1935 | Italy | 9/2 A |

*Primary Examiner*—Robert B. Reeves

*Assistant Examiner*—Edward M. Wacyra

*Attorney, Agent, or Firm*—R. S. Sciascia; Henry Hansen; William J. Iseman

[57] ABSTRACT

A mini-boat having an inflatable, hollow configuration for safely supporting persons in water. Two similarly shaped sheets of inflatable material are sealed together near their peripheral edges thereby forming two mirror imaged sections about an axis of symmetry at the stern of the mini-boat, the maximum depth preferably being near the axis and the sections tapering downwardly toward their distal ends at the bow. The sheets are further seamed together along a plurality of lines so spaced within the sealed sections as to define an array of relatively narrow interconnecting inflation cells. The sections are then folded at the axis and the opposing lower and distal edges are sealed together to define the keel and bow of the hull. The cells are inflated orally or by gas and are shaped to provide a lounge chair contour and attitude under the weight of an occupant whose inclined back lies against the axis with the buttocks at the point of maximum depth so that the body thereby becomes the thwart structure for the compliant hull.

15 Claims, 6 Drawing Figures

MINI-BOAT

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates generally to pneumatically inflated small boats and methods for making same and particularly to the structure and method for making an inflatable mini-boat having a compliant hull structure sealingly formed from two mirror imaged sections of inflatable material.

Small pneumatically inflated rafts having capacities of one or more persons have long been used for recreational purposes on relatively placid waters and also as life rafts in emergency situations. Typical designs of such rafts basically provide for a ring shaped closed tube or toroid fabricated from tailored segments of an elastomer coated fabric and bonded together with adhesives. These rafts have floors of similar material likewise bonded to the fabric of the tube and spanning the enclosed areas so as to support the occupant above the water and within the confines of the tube. Such designs do not conform easily to high production techniques and are relatively expensive. In a tubular hulled pneumatic raft, the pressure of the contained gas distends the tube until the wall is taut and expands it laterally to stretch the floor and provide the characteristic structural stiffness of these craft. In the smaller sizes of these rafts, the center of gravity of the seated occupant's body is often too high with respect to the center of buoyancy of the tube to afford stability in rough water, thereby resulting in serious insecurity for the occupant if the water is slightly turbulent. Another type of raft, often motorized, comprises principally a parallel pair of spaced apart pneumatic pontoons which form a lateral structure having a faired bow separating the pontoon, a floor of coated fabric, and a floored structure including a transom for supporting the motor. This type of raft is seldom used for emergency life support where compact stowage and fast emergency deployment and boarding are critical design factors.

SUMMARY OF THE INVENTION

Accordingly, it is an object of the present invention to provide a mini-boat structure having a novel inflatable geometry which is particularly adapted for single, dual or tandem occupancy. Another object of the present invention is to provide a mini-boat which is readily inflated, deployed and boarded and which maximizes the comfort of the occupant and stability in rough water. Still another object of the invention is to provide a mini-boat which is packageable, ready for inflation and deployable thereby in a fraction of the weight and volume formerly required by other style rafts. Another object of the invention is to provide a mini-boat and method for making same requiring relatively low fabrication costs and noncomplex manufacturing methods suitable to high production techniques.

Briefly, these and other objects are accomplished by a mini-boat having an inflatable hull configuration for safely supporting persons in water. Two similarly shaped sheets of inflatable material, such as an elastomer-coated or sheet vinyl fabric, are heat sealed together near their peripheral edges by heat or chemical bonding forming two mirror-imaged sections about an axis of symmetry formed at the stern, the maximum depth of the mini-boat preferably being near said axis and the sections tapering downwardly toward their distal ends at the bow. The sheets are further seamed together along a plurality of lines so spaced within the sealed sections as to define an array of relatively narrow interconnecting inflation segments. The sections are then folded at the axis and the now opposed lower and distal edges are seamed together just outboard of the first seal to define the keel and bow of the hull. The tapered contour and the spacing of the included lines are proportioned to optimize the inflation gas distribution, free-board, and stability achievable from a limited area of sheet material and a minimal supply of inflation gas in a hull shaped to assume a lounge chair contour and subject to the weight of an occupant whose inclined back lies against the axis with the buttocks at the point of maximum depth. The body thereby becomes the thwart structure for the compliant hull which is proportioned to yieldingly accommodate persons of widely diverging sizes. Derivative designs will accommodate two or more persons.

For a brief understanding of these and other aspects of the invention, reference may be made to the following detailed description in conjunction with the accompanying drawings.

DESCRIPTION OF THE PREFERRED EMBODIMENT

Figure 1:
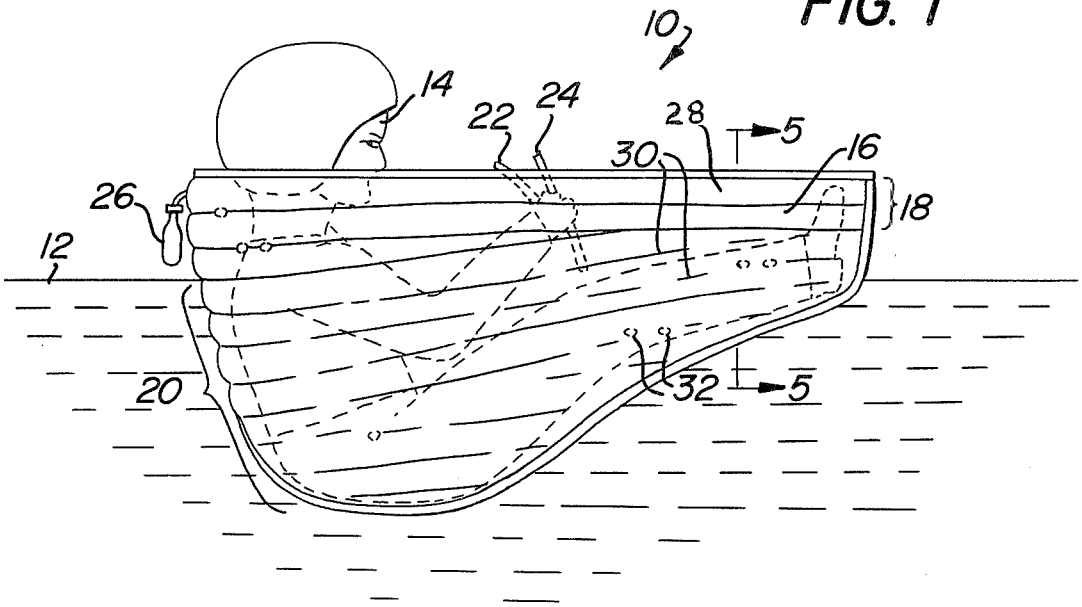
FIG. 1 is a side elevation view of a compliant hull made according to the present invention and shown supporting an occupant therein.

Referring now to FIG. 1, there is shown a side elevation view of a mini-boat 10 buoyantly positioned within a water body 12 and supporting an occupant 14. The boat 10 comprises a plurality of inner and outer inflatable panels of which the outer panel 16 is shown in this view. The panel 16 is partitioned into a pair of pneumatically inflatable cells 18, 20 which are independently inflatable from each other. Each of the cells 18, 20 is provided with an oral inflation hose 22, 24 positioned interior to the boat 10 and, in this example, to the right hand side of the occupant 14. A gas cylinder 26 is connected to the upper cell 18 at the stern of the boat 10 and provides the primary inflation source for the upper cell. The sealed panels which sealingly cooperate to form the hull configuration for the mini-boat each comprise a plurality of tubular segments 28 formed therein intermediate corresponding seams 30 having end terminations formed of spot welds 32. The remaining panels (not shown) in the mini-boat are formed substantially in conformance with the seamed structure of panel 16, the details of which will be explained hereinafter.

Figure 2:
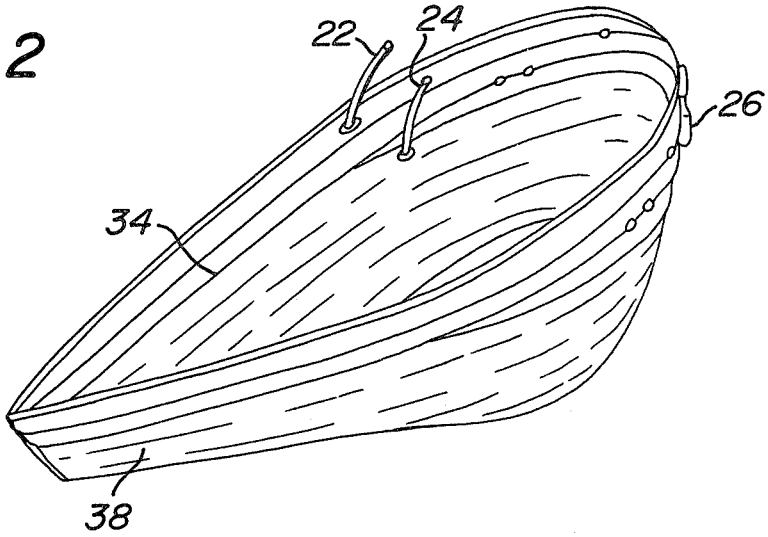
FIG. 2 is a perspective view of the compliant hull shown in FIG. 1 and which further indicates novel structural details of the invention.

Referring now to FIG. 2, there is shown a perspective view of the boat 10 shown in FIG. 1 with greater details disclosed as to the configuration of the invention. More clearly shown is a portion of the interior surface of the boat 10 having a right side inner panel 34 positioned interior to the boat and adjacent the corresponding outer panel 16. Correspondingly, a mirror imaged left side panel (not shown) is positioned interior to the boat and adjacent the left side outer panel 38.

Also more clearly shown is the positioning of the oral inflation hoses 22, 24 with respect to the corresponding upper and lower cells 18, 20.

Figure 3:
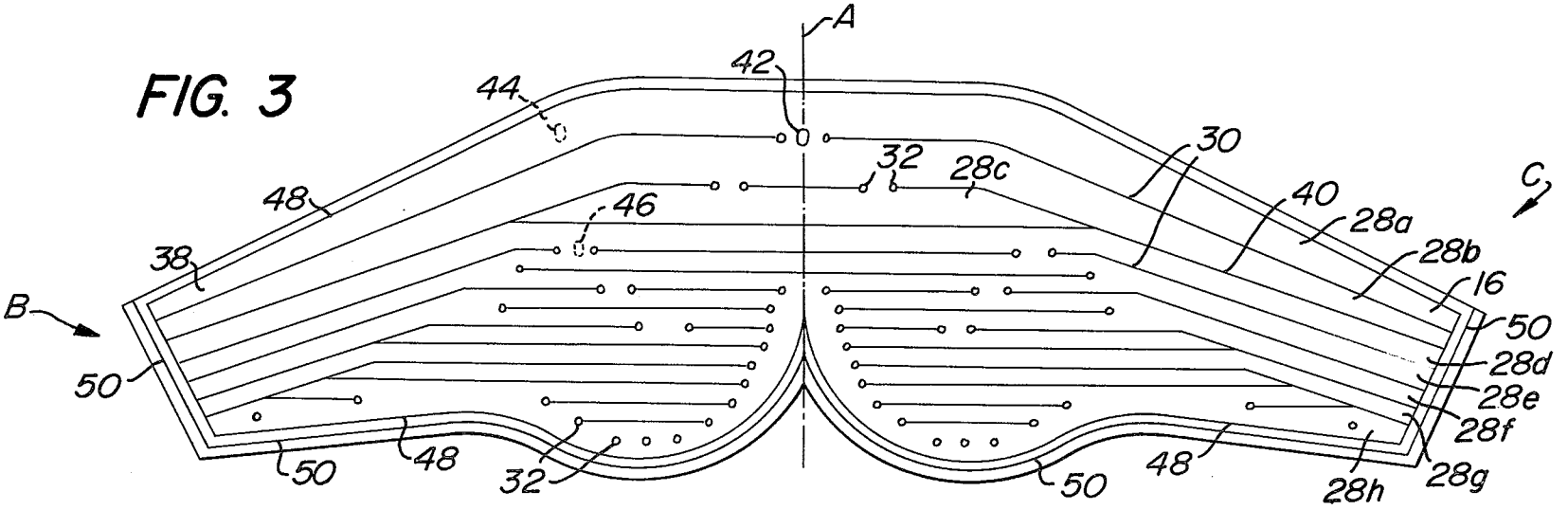
FIG. 3 is a showing of the symmetrical pattern which is used to fabricate the inner and outer panels of the invention shown in FIG. 1, together with the location of seaming lines and inflation device entrances.

Referring now to FIG. 3, there is illustrated the pattern shape of material, including seam lines, used in the fabrication of the hull of the invention. The right side outer panel 16 and corresponding left side outer panel 38 are symmetrical in their shape and form mirror images of one another about an axis A bisecting the panels. Seam lines are denoted, for example, by lines 30 and correspondingly terminated by weld spots 32. Tubular segments 28*a*, 28*b*, and 28*c* define the upper inflatable cell 18 which is sealed from the lower cell 20 by seam 40, the remaining tubular segments denoted partially as segments 28*d*, 28*e*, 28*f*, 28*g* and 28*h* form the lower cell 20. Air passages between the respective segments 28 are formed by the positioning and spacing of the spot welds 32 and thereby permit controlled inflation of the segments within each of the cells. The upper cell 18 is provided with an orifice 42 positioned along the axis A and is adapted to be connected to the gas cylinder 26 shown in FIG. 1. Similarly, orifices 44, 46 are formed, respectively, in the upper and lower cells 18, 20 of the hull and are each adapted to be connected to the corresponding oral inflation hoses 22, 24. The upper cell 18 is sealingly partitioned from the lower cell 20 by means of the continuous seam 40 traversing the lengths of the panels 16, 38. Additional spot welds 32, not directly connected to a seam, are provided at the respective lower extremities of each of the mirror pattern sides which also serve to seal the inner panels (not shown) to the respective corresponding outer panels 16, 38. The corresponding inner and outer panels are sealed to one another by a first seam 48 which continues around the entire periphery of the pattern shown in the figure. Seam 48 also serves to seal off the distal ends of the respective tubular segments 28*a–h* and the corresponding mirror imaged segments on panel 38 terminating at the bow of the hull. A second seam 50 is formed throughout the periphery of both the bow and keel of the respective panels shown in the figure. Seam 50 denotes the areas over which mirror imaged sections B and C each comprising correspondingly sealed inner and outer panels, will be sealingly attached to one another when folded in opposing relationship such as shown in FIG. 2.

Figure 4:
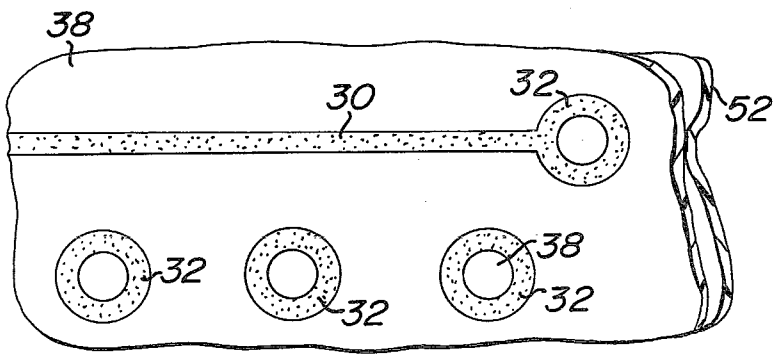
FIG. 4 is a fragmentary view of one portion of the invention and illustrating seam end termination and spot welds used in the construction of the invention.

Referring now to FIG. 4, there is shown a magnified fragmentary portion of a seam 30 and a plurality of spot welds 32 utilized in sealing a portion of the outer panel 38 to the corresponding inner panel 52 of the hull. The spot welds are each shaped in the form of a circle with the interior circular area thereof being left unwelded. This type of termination requires the expending of a lesser amount of heat sealing energy than a termination of the type having a completely welded circular area which obviously may be employed, if desired. More clearly shown is the sealing of a portion of the outer panel 38 to a corresponding portion of the inner panel 52. Each of the panels may be fabricated from a nylon type material impregnated with an inner elastomer material which faces the interior portion of the tubular segment 28 or a single layer of flexible and sealable material such as sheet vinyl.

Figure 5:
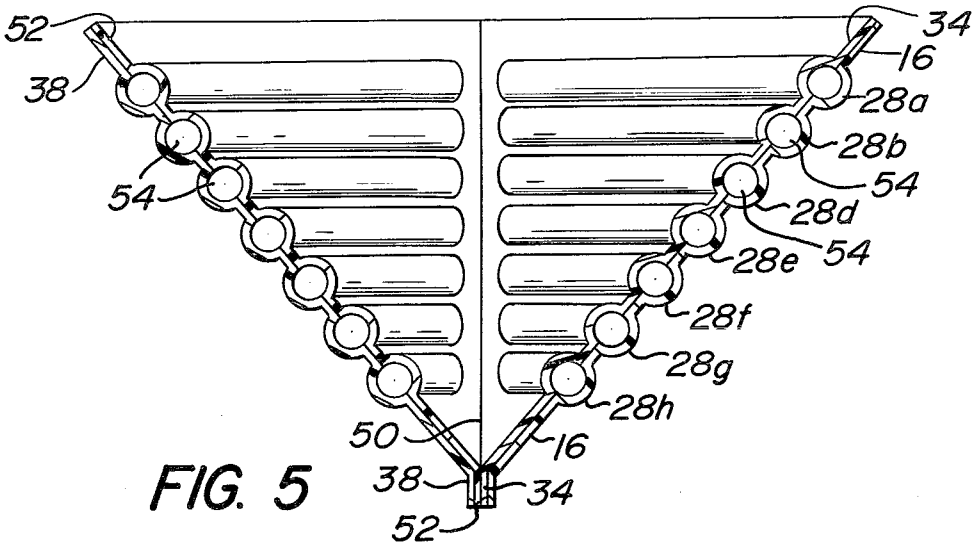
FIG. 5 is a sectional view of the invention taken along the lines 5—5 noted in FIG. 1 and viewed toward the interior of the bow.

Referring now to FIG. 5 there is shown a sectioned view of a portion of the invention taken along the lines 5—5 noted in FIG. 1. More clearly shown is the relationship between the outer panels 16, 38 and respective corresponding inner panels 34, 52 sealingly formed into mirror imaged sections and joined at the keel and bow by seam 50. Also more clearly shown are the formation of the tubular segments 28 and some of the inflatable air spaces 54 formed therein.

Figure 6:
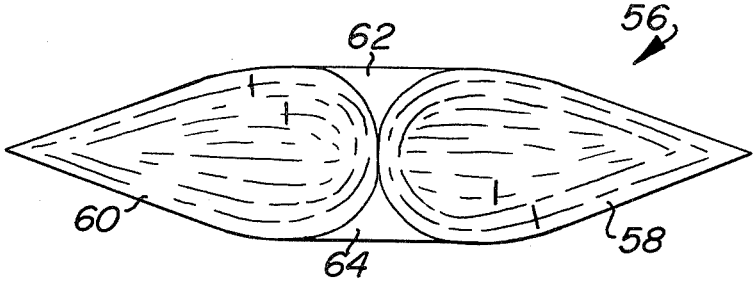
FIG. 6 is a top view of an arrangement for a two man mini-boat made according to the present invention.

Referring now to FIG. 6, there is shown a plan view of a two person mini-boat 56 fabricated according to the present invention and capable of supporting two occupants. The two person mini-boat comprises a pair of hulls 58, 60 configured according to the preceding drawings and placed back to back in the manner shown. A pair of outer covers 62, 64 are provided on the respective opposing sides of the two man mini-boat to smooth the outside contours thereof and to provide additional bonding strength between each of the hulls which are bonded to one another at the respective sterns thereof in any convenient fashion.

Referring now to FIGS. 1–6, the structure and method of manufacturing the mini-boat of the present invention will now be explained in greater detail. The preferred pneumatic vessels of this invention are shaped like a small boat rather than a raft, the preferred deep curved keel additionally providing the occupant or occupants with a restful floating posture similar to that yielded by a lounge chair as may be inferred from FIG. 1 showing a side view of the occupant 14 within the mini-boat. The outer and inner walls of the inflatable hull of the boat are derived by pairing outer and inner panels formed according to the pattern of FIG. 3 and weld sealing them together peripherally and at intermediate intervals to contain the inflation gas therein and to limit the capacity therefore, while tailoring the deeply tapered hull and the thickness of the hull walls to optimum buoyancy and stability in rough water for a very wide range of sizes of occupants. The similarly shaped panels, both inner and outer, are bonded to each other along the continuous outline seam 48 which is symmetrical about the axis A and defines, in each section, a lounge chair contour leading away from the axis on a first edge, a flattened bow on a second edge distal from the axis and a longitudinal gunnel along a third edge extending from the bow back to the axis. The seamed assembly comprising sections B and C as formed in FIG. 3 defines the shape that the boat will subsequently take when folded in half about axis A and bonded along seam 50 which bonds the keel and the continuation thereof which closes and forms the bow. If more than one sealed inflation cell is to be provided in the hull, additional continuous seams such as seam 40 may be welded from end to end of the pattern panels, preferably before the folding operation, to divide the hull into additional separate cells in any manner that seals off one cell of the inflatable hull from another. The inner and outer panels are bonded together along a plurality of discontinuous seam lines such as seams 30 to limit the inflation capacity and define the hull wall thickness which is preferably much less at the bottom where the seam lines are more closely spaced than at the top. The largest diameter inflated segment, in the preferred embodiment segment 28*a*, and consequently, the longest segment will preferably be close to the top of the mini-boat and longitudinally lined as shown in FIG. 1 for minimum water drag and optimized roll damping. The alignment of most of the other segments will be generally horizontal. The most convenient configuration for boarding the mini-boat on the water occurs when only the upper cell is inflated, following which the lower cell can be easily inflated orally via an oral inflation tube. The inflated compartments provide insulation for the occupant as well as flotation. Either of the cells 18, 20 can be topped up periodically with air by the use of the corresponding inflation tubes 22, 24 which each incorporate a check valve to prevent the loss of the inflating gas.

Referring again to FIG. 3 the preferred hull for the one man pneumatic boat is most conveniently formed of a pair of flat patterns cut from either elastomer coated woven fabric or unsupported sheet elastomer such as vinyl or olefin sheet of considerably heavier aggregate thickness. The shape of the pattern shown in FIG. 3 enables maximum utilization of fabric across the full width of an economical 44 inch wide roll, while providing full tapering of the hull shaped at both ends and both of the hull sides and the hull wall thickness as well. At the same time, it will provide for concentration of most of the flotation capacity of both the upper and lower cells about the torso of the occupant so that the mini-boat will ride stably and well balanced despite wide variations and sizes of occupants. Each of the pair of such panels that would be welded together into a boat would ordinarily be prepared before assembly with whatever welded-on or adhesed inflation valves, oral inflation tubes, localized reinforcements etc which may be appropriate for the intended service. If the fabric is coated with a thermoplastic elastomer such as vinyl or urethane, it is amenable to direct welding of the coated side via either the dielectric or the ultrasonic process and even by thermal conduction through the fabric into the coating layer. It will be understood that the extreme thinness of the fabric and of its coating in which the welding actually takes place makes it necessary to enlarge the thicknesses disproportionately relative to other dimensions. The longitudinal seams in the mini-boat need only be from a one-sixteenth inch to a one-quarter inch wide if adequate provision is made for relief from the high levels of stress which ordinary exist at the narrow seam terminations on both sides of the tubular segments when the boat is inflated. Lifting or peeling of the weakened elastomer coating from the parent supporting fabric causing leakage through the thus unsealed fabric is the most likely consequense of such local separation of the coating together with the possibility of localized distortion of the fabric weave or even the tearing of threads at such point. The enlarged circular seam terminations or spot welds such as shown in FIGS. 3 and 4 are provided to maintain the stress at a moderate value comparable with the stress values along the side of the linear seams.

The primary purpose of dividing the walls of both singly and plurally compartmented boat hulls via seaming lines arranged in the general manner of FIG. 3 is to control the overall taper of the hull thickness. The inflated hull is preferably thicker towards the top edge and toward the aft end of the boat where the maximum passage weight and wave oscillated inertia loads are supported. To accomplish this and to provide maximum stability and more proportioned freeboard, the boat is preferably deeper and the hull is generally thicker around the torso of the occupant than at the foot end. While optimum body insulation is achieved through inflation down through and under the buttocks, such considerations as sea keeping stability and the stowage weight and the bulk of packed boats limit the desirable inflation thickness so that the seaming lines shown are more closely spaced toward the keel.

Hull thickness may optionally be controlled via distribution of a multiplicity of spot welds 32, as shown in FIG. 4, instead of linear seams throughout the areas of cells 18, 20 of FIG. 1, similarly forming interconnecting inflatable segments and giving the surface a tufted appearance.

Thus it may be seen that there has been provided a novel mini-boat which is easily fabricated from mirror imaged fabric patterns and which supports a wide variety of differently sized occupants in a safe and comfortable flotation position.

Obviously, many modifications and variations of the invention are possible in light of the above teachings. It is therefore to be understood that within the scope of the appended claims the invention may be practiced otherwise than as specifically described.

What is claimed is:

1. An inflatable mini-boat, comprising:

a compliant inflatable hull of inner and outer panels and having a deep stern portion contoured at the point of maximum depth to contiguously support the buttocks and back of an occupant seated therein, and a shallow bow portion contoured to contiguously support his legs extended forwardly and upwardly, said hull being partitioned by discontinuous seams of preselected spacing to each other between the opposed surfaces of said panels and co-directional with the length of the mini-boat to form a plurality of varying-width tubular segments intercommunicating through the passages formed by the discontinuities in the seams; and means for inflating said hull;

whereby the inflation capacity is limited to selected areas for maximum stability.

2. A mini-boat according to claim 1 wherein:

said tubular segments being relatively narrow near the bottom and toward the bow portion, and relatively wide near the top and toward the stern portion.

3. A mini-boat according to claim 2 wherein:

said hull is further partitioned by continuous seams between said opposed surfaces and co-directional with the length of the mini-boat to form a plurality of separately inflatable cells, each of said cells being positioned around the stern and extending forwardly along either side terminating at the bow; and said inflating means includes oral inflating means connected to the lowermost cell for inflation by the occupant, and compressed gas supply means connected to the uppermost cell for mechanical inflation.

4. An inflatable mini-boat according to claim 3 wherein:

an outer perimeter of said cells along the bow and bottom of the hull are sealingly joined to form a stem and keel, respectfully.

5. A mini-boat according to claim 1 further comprising:

a second compliant inflatable hull configured like said first-recited hull connected stern-to-stern to support a second occupant in the opposite direction of said first-recited occupant.

6. A mini-boat according to claim 5 further comprising:

cover means respectively connected to the opposing sides of said hulls for providing smooth sides at the connection of said hulls.

7. An inflatable mini-boat for supporting two occupants, comprising:

a compliant inflatable hull contoured to closely conform to the occupants seated midship back-to-back with their legs extended toward the respective ends of the hull, said hull having opposed pluralities of inflatable cells, each of said cells being stacked one upon the other and being positioned around midway and coextending forwardly along either side terminating at the opposite ends of the hull, and the outer perimeter of said cells along the ends and bottom of the hull being sealingly joined to form stem- and keel-like seams, and outer covers connected to either side midship for providing smooth sides between said opposed pluralities of cells; and means for independently inflating said cells;

whereby the body of each occupant forms the thwart structure of said hull when fully inflated.

8. A mini-boat according to claim 7 wherein said cells further comprise:

an upper cell forming the gunnel of the hull; and a lower cell connected along the length thereof to said upper cell.

9. A mini-boat according to claim 8 wherein said inflating means further comprises:

oral inflating means connected to said lower cell for inflation by one of the occupants; and compressed gas supply means operatively connected to said upper cell for mechanical inflation thereof.

10. A mini-boat according to claim 9 wherein each of said cells is partitioned along its length into a plurality of interconnected tubular segments communicating through prearranged passages for inflation into the hull contour.

11. A method for fabricating a mini-boat comprising the following steps:

patterning a first panel of gas impervious compliant material, said panel having a pair of mirror-imaged sections formed about a symmetrical axis, each of said sections comprising a substantially lounge chair contour formed along a first edge thereof extending from said axis to a second edge distal thereform and returning to said axis along a third edge, said first, second and third edges forming respectively, one side of the keel, bow and gunnel of the mini-boat;

forming a second panel identical to said first panel and superimposing said first and second panels over one another in symmetrical relationship;

sealing the outer peripheries of said first and second panels to one another, partitioning the sealed panels into a plurality of inflatable cells by forming at least one continuous longitudinal seam between said panels and said opposing respective second edges of each of the sealed sections;

forming at least one orifice in each of the partitioned cells for permitting the ingress of a gaseous medium;

sealing by prearranged discontinuous seams respective ones of the partitioned cells into a plurality of inflatable tubular segments, each of said tubular segments inflatably communicating with the other within a common cell;

folding the sealed sections over one another about said axis; and sealing the opposing first and second edges of each of said folded sections to each other to form the keel and bow of the mini-boat.

12. A method according to claim 11 further comprising the step of attaching inflation means to the orifices.

13. A method for fabricating a mini-boat comprising the following steps:

patterning a first panel of gas impervious compliant material, said panel having a pair of mirror-imaged sections formed about a symmetrical axis, each of said sections comprising a substantially lounge chair contour formed along a first edge thereof extending from said axis to a second edge distal therefrom and returning to said axis along a third edge, said first, second and third edges forming respectively, one side of the keel, bow and gunnel of the mini-boat;

forming a second panel similarly contoured to said first panel and superimposing said first and second panels over one another in symmetrical relationship;

sealing the outer peripheries of said first and second panels to one another forming an inflatable hull;

forming orifice means in the hull for permitting the ingress of a gaseous medium;

sealing the hull by prearranged longitudinal discontinuous seams between opposed surfaces thereof into a plurality of inflatable tubular segments, each of said tubular segments inflatably communicating with the other through the discontinuities formed by the seams;

folding the sealed panels over one another about said axis; and sealing the opposing first and second edges of each of said folded sections to each other to form the keel and bow of the mini-boat.

14. A method according to claim 13 wherein the discontinuous seams are narrowly spaced near the bottom and toward the bow, and widely spaced near the top and toward the stern.

15. A method according to claim 14 further comprising:

sealing the panels by a continuous longitudinal seam between opposed surfaces thereof into a plurality of separately inflatable cells; and separating the orifice means into separate inflating means for the respective cells.

* * * * *